US005180351A

United States Patent [19]

Ehrenfried

[11] Patent Number: 5,180,351

[45] Date of Patent: Jan. 19, 1993

[54] SIMULATED STAIR CLIMBING EXERCISE APPARATUS HAVING VARIABLE SENSORY FEEDBACK

[75] Inventor: Ted H. Ehrenfried, Portsmouth, Va.

[73] Assignee: Alpine Life Sports, Suffolk, Va.

[21] Appl. No.: 767,692

[22] Filed: Oct. 21, 1991

[51] Int. Cl.[5] ..... A63B 22/04

[52] U.S. Cl. ..... 482/52; 482/6; 482/51

[58] Field of Search ..... 482/51, 52, 53, 5, 6, 482/148

[56] References Cited

U.S. PATENT DOCUMENTS

| | | | |
|---|---|---|---|
| 4,685,669 | 8/1987 | DeCloux | 482/52 |
| 4,720,093 | 11/1984 | Del Mar | 482/52 |
| 4,848,737 | 7/1989 | Ehrenfield | 482/52 |
| 5,013,031 | 5/1991 | Bull | 482/52 |

*Primary Examiner*—Stephen R. Crow
*Attorney, Agent, or Firm*—Raymond L. Greene

[57] ABSTRACT

A simulated stair climbing exercise apparatus having variable sensory feedback is provided. Sensory feedback, in the form of a lifting force acting on a lifting foot of the operator, varies with the operator's location in the stepping stroke. Maximum sensory feedback is provided at a lower portion of the stroke, minimum sensory feedback is provided at an upper portion of the stroke and maximum feedback at the lower portions. Sensory feedback is effected by means of direct interconnection of left and right foot mechanisms in combination with a spring. Direct interconnection is achieved by a cable routed around a series of pulleys such that a downward force on one foot mechanism results in an equal and opposite lifting force on the other foot mechanism. One of the pulleys is a floating pulley that is free to move and its positioned based upon the operating position of the stepping stroke. The spring is connected to the floating pulley such at 1) the direct interconnection cable controls the lifting force in the lower portion of the stroke, 2) the spring controls the lifting force at the upper portion of the stroke, and 3) a combination of the cable and spring control lifting force in the mid range.

7 Claims, 6 Drawing Sheets

SIMULATED STAIR CLIMBING EXERCISE APPARATUS HAVING VARIABLE SENSORY FEEDBACK

FIELD OF THE INVENTION

The invention is related to the field of exercise equipment and more particularly to low impact exercise equipment designed to simulate stair climbing.

BACKGROUND OF THE INVENTION

Stair climbing exercisers are generally known in the art and may be categorized as either real climbing or simulated climbing exercisers. Real climbing exercisers are characterized by motor driven, escalator-type revolving staircases. Revolving staircases, however, are generally expensive, occupy a great deal of floor space and require a high degree of operator coordination. Accordingly, simulated climbing exercisers have been developed to overcome these drawbacks. Simulated climbers generally comprise a left and right pedals or steps and may be further categorized as having independent or dependent stepping action, both of which have inherent advantages and disadvantages depending on the needs of the individual user.

Dependent stepping action is characterized by the dependency of motion between the left and right steps. In particular, the left step moves up as the right step reciprocally moves down and vice versa. The reciprocal downward force imparted by the operator's stepping action results in an opposite upward force on the upward moving step. The advantage of this action is that no operator coordination is required. The action provides the operator with sensory feedback as to when he should lift each foot. Thus, the occasional, or possibly handicapped, exerciser is provided a safe simulated stair climbing exercise. The disadvantage of this action is that only a contrived step action is achieved resulting in fewer calories burned.

In contrast, independent stepping action is characterized by the independence of motion between the left and right steps. In particular, the movement of the left step has no effect on the right step and vice versa. Typically, each left and right step is equipped with a return spring. The return spring has sufficient force to return each step to a stepping position after the downward force is removed and the operator has lifted his foot in anticipation of the next step. The advantage of this action is that a different workout is achieved since the operator must lift his own foot with each step and may exercise each leg at a different level of effort. The disadvantage is that a greater level of coordination and/or strength is required to use such an exerciser. No upward force aids the lifting foot with each step or even provides sensory feedback as to when the operator should lift each foot.

SUMMARY OF THE INVENTION

Accordingly, it is an object of the present invention to provide a stair climbing exerciser that is capable of a range of dependency based upon the needs of the operator.

It is a further object of the present invention to provide a stair climbing exerciser having a varying sensory feedback system for alerting the operator, at the proper time, to lift a particular foot.

Still another object of the present invention is to provide a stair climbing exerciser that may be operated safely by the occasional user and operated to deliver a high-intensity workout for the experienced user.

Other objects and advantages will become more obvious hereinafter in the specification and drawings.

In accordance with the present invention, an exercise apparatus for simulating a stair climbing exercise is provided. The apparatus includes a base and a frame extending therefrom. The base houses the functional components of the invention while the frame provides the operator a means for balancing his upper body when performing the stair climbing exercise. The base houses left and right foot mechanisms, each of which has a left and right foot support step, respectively, extending from the base. The foot support steps are permitted to travel in substantially vertical upward and downward strokes. An operator places his left and right feet on the left and right foot support steps, respectively, such that the left and right feet of the operator alternately become the lifting foot in the stair climbing exercise. Connected to the left and right foot mechanisms is a means for providing sensor feedback to the lifting foot. Maximum sensory feedback is provided at a lower portion of the left and right strokes for a safe exercise routine. Minimum sensory feedback is provided at an upper portion of the left and right strokes for a high-intensity exercise routine. Sensory feedback is realized as a lifting force alternately acting on the left and right foot support steps respectively supporting the lifting foot. The lifting force gradually increases from the minimum to the maximum between the upper and lower portions of the left and right strokes.

DETAILED DESCRIPTION OF THE INVENTION

Figure 1:
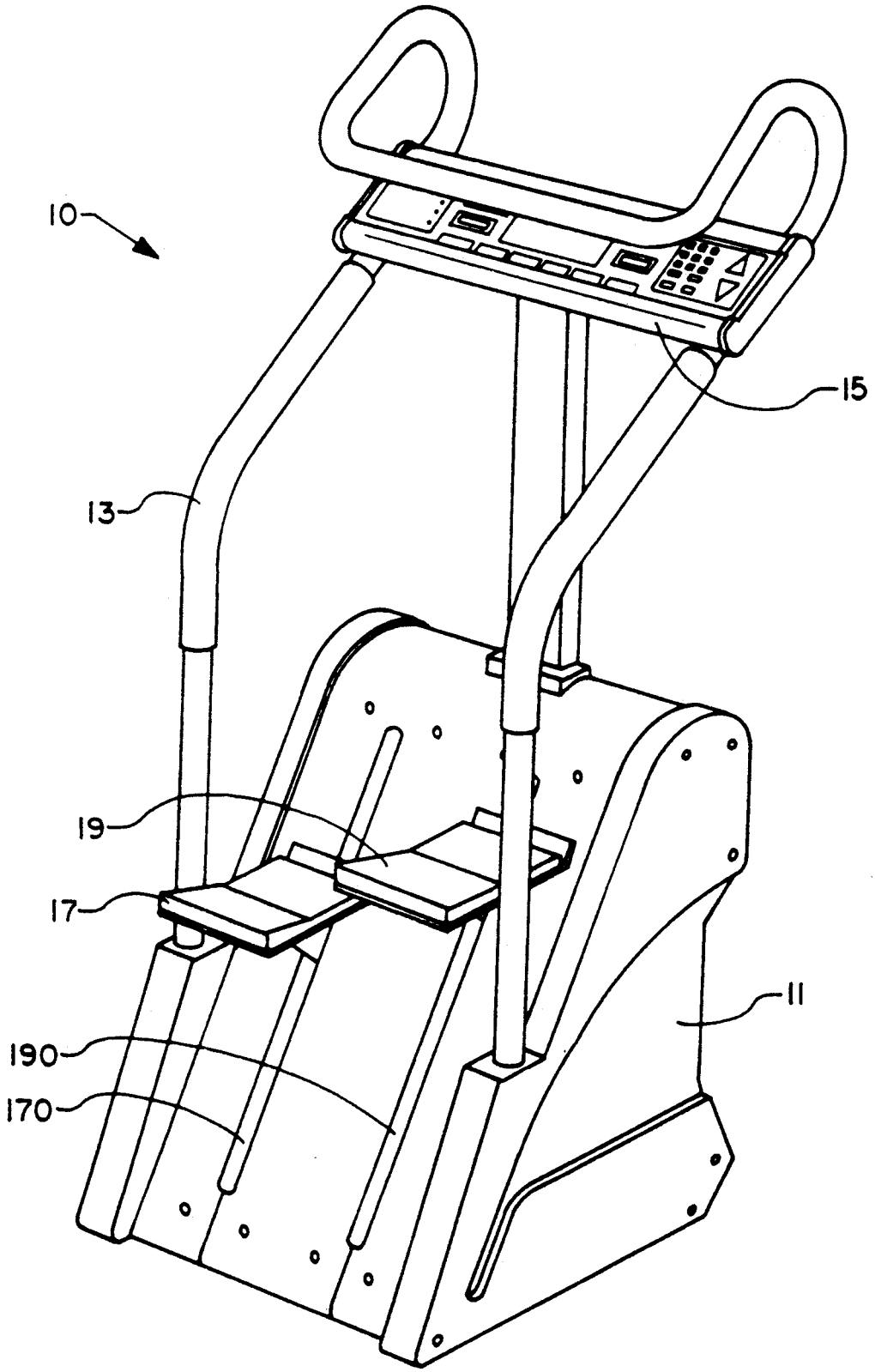
FIG. 1 is an overall, perspective view of the stair climbing apparatus according to the present invention.

Referring now to the drawings and in particular to FIG. 1, the overall stair climbing exerciser is shown designated generally by the numeral 10. Stair climbing exerciser 10 includes a base 11 and frame 13 extending therefrom. Base 11 houses the functional components of the invention which will be described hereinafter. Frame 13 provides an operator with a means for balancing his upper body when performing the stair climbing exercise. Also provided is a microprocessor control panel 15 attached to frame 13. Control panel 15 allows the operator to adjust the descent speed of the exerciser throughout the exercise routine and provides the operator with information such as number of stairs climbed, calories burned, and other data. The design and functions of control panel 15 however may vary greatly and in no way should be considered to constrain the essential features of the present invention.

Extending from base 11 are left and right foot support steps 17 and 19. Each foot support step is constrained to travel in a substantially vertical stroke within left and right stroke slots 170 and 190. Stroke slots 170 and 190 are parallel and linear. The stroke in the preferred embodiment is aligned, but not limited to, approximately 60° with respect to the floor or: which exerciser 10 is placed.

For a more complete understanding of the design of the present invention, it is first useful to understand its functions and then the structure leading thereto. In the case of an inexperienced operator requiring the safety advantage of dependent stepping action, the present invention provides sensory feedback to the operator in the form of a lifting force acting on the operator's lifting foot. This lifting force is maximized when both left and right foot support steps 17 and 19 are operating in the lower portion of their respective stroke slots 170 and 190. As one foot forces its support step downward, an equal and opposite lifting force is applied to the lifting foot support step thereby providing a rhythmic easily coordinated action. In contrast, when an experienced operator desires a high-intensity workout, typically delivered by an exerciser exhibiting independent stepping action, the present invention minimizes the amount of lifting force acting on the lifting foot support step. The lifting force is minimized when both left and right foot support steps 17 and 19 are operating in the upper portion of their respective stroke slots 170 and 190. Furthermore, the structure of the present invention gradually increases the amount of lifting force as the operator's range of strokes moves from the upper to the lower portions of stroke slots 170 and 190. The degree independence and the vertical location along the step stroke where the transition between dependent and independent step actions occurs may be adjusted as further described herein.

Figure 2A:
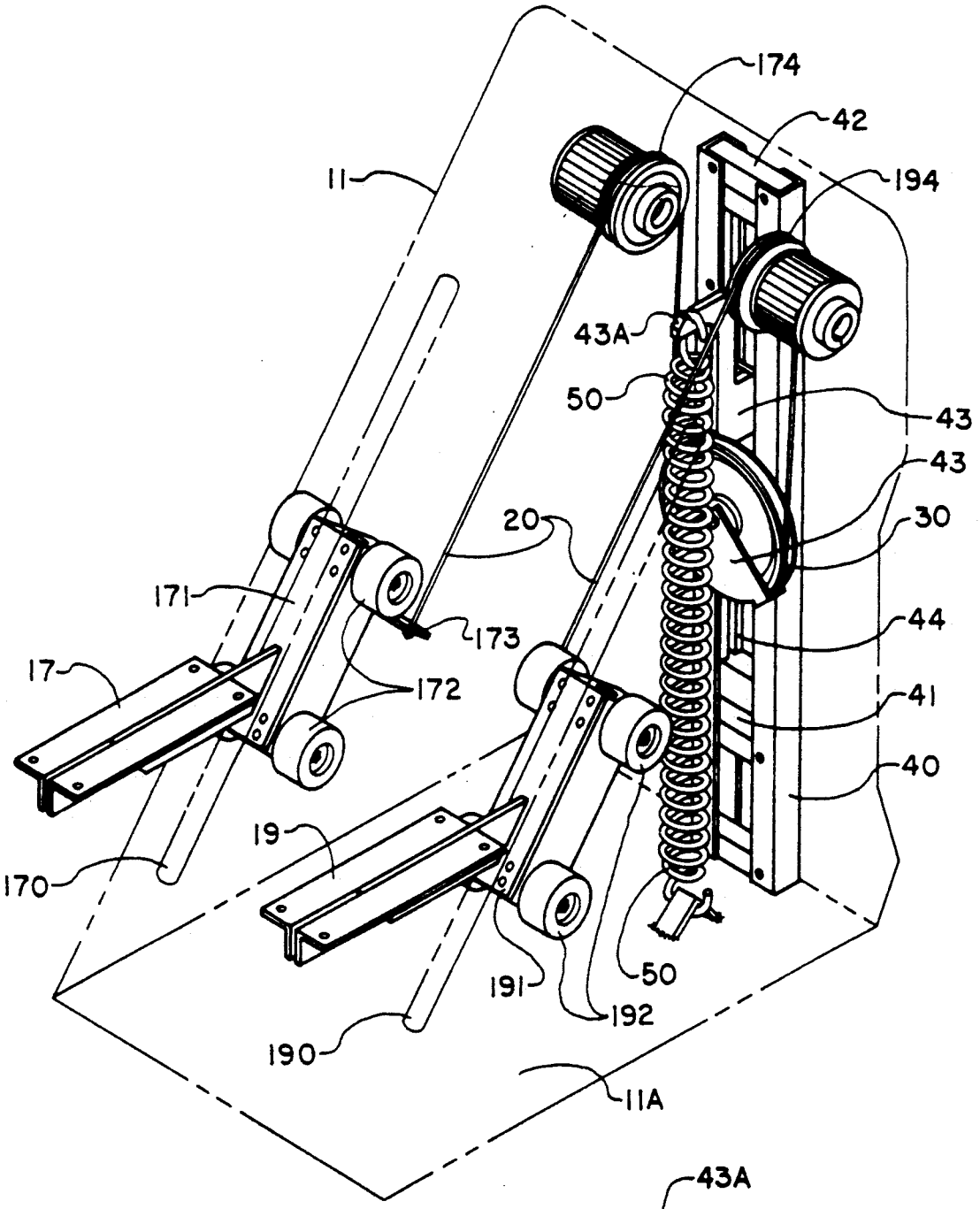
FIG. 2(A) is an isolated perspective view of the left and right foot mechanisms operatively connected to the sensor feedback means according to the present invention.
Figure 2B:
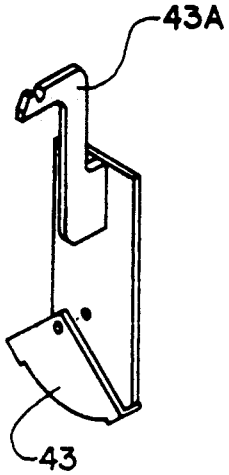
FIG. 2(B) is a perspective view of the mounting bracket used to support the floating pulley and spring in the present invention.

The means for achieving the range of sensory feedback is shown in isolation in the perspective view of FIG. 2(*a*) where left and right support steps 17 and 19 are attached to left and right foot mechanisms 171 and 191 housed within base 11. Mechanisms 171 and 191 each include a plurality of wheels 172 and 192 on which mechanisms 171 and 191 travel within a track (not shown in this drawing for purposes of clarity) throughout their respective strokes.

A cable 20 is fixably attached to mechanism 171 via a mounting plate 173. Although not shown, cable 20 is fixed to mechanism 191 in similar fashion. Accordingly, cable 20 provides a direct interconnection of mechanisms 171 and 191. Cable 20 is routed between mechanisms 171 and 191 via a series of pulleys. In particular, cable 20 wraps over the top of left mechanism pulley 174, under a floating pulley 30 and then back over the top of right mechanism pulley 194. Pulleys 174 and 194 are fixed within base 11 by any conventional means while floating pulley 30 is free to move vertically between lower and upper stops 41 and 42, respectively, of a pulley guide 40. Pulley guide 40 is fixed to the floor 11*a* of base 11 and extends vertically upward into the base 11. Floating pulley 30 is fixed to a mounting bracket 43 which moves vertically within guide slots 44 of pulley guide 40. Mounting bracket 43 is shown in greater detail in the perspective view of FIG. 2(*b*).

The direct interconnection described above, if taken alone, would function as follows. When an operator places his left ant right feet on support steps 17 and 19, floating pulley 30 travels to the upper stop 42 as support steps 17 and 19 travel to the lower portion of the stroke slots 170 and 190. In this mode, a downward stroke of one support step generates an equal reciprocating upward stroke on the other step. Since floating pulley 30 is fixed against upper stop 42, dependent movement of support steps 17 and 19 results from their direct interconnector by cable 20. Thus, a maximum amount of sensory feedback is experienced.

In order to allow the operator to reduce the amount of sensory feedback, the present invention makes use of a spring 50 fixed on one end to the floor 11*a* of base 11 and on the other end to a hook 43*a* on mounting bracket 43. When no forces are applied to support steps 17 and 19, spring 50 maintains floating pulley 30, via mounting bracket 43, at lower stop 41 while support steps 17 and 19 reside at an upper portion of their respective stroke slots 170 and 190. By combining spring 50 with floating pulley 30, the present invention allows an operator to choose maximum sensory feedback with dependent action minimum sensory feedback with independent action, or any amount of feedback therebetween.

For example, a maximum sensory feedback workout is achieved by an operator exercising at the lower portion of stroke slots 170 and 190. In such a case, the operator allows his weight to overcome the tension in spring 50 thereby causing floating pulley 30, via mounting bracket 43, to contact upper stop 42. As the operator increases the intensity of the workout, he merely increases his stepping speed thereby allowing the tension in spring 50 to move floating pulley 30 downward as support steps 17 and 19 move upward in their stroke slots 170 and 190. The amount of sensory feedback gradually decreases as floating pulley 30 moves toward lower stop 41 at which point a minimum amount of sensory feedback is supplied to a lifting foot. This results in spring 50 supplying the impetus for the lifting force. Since spring 50 is not strong enough to overcome the weight of the operator, the operator, by the intensity of his workout, can determine how much expansion will be experienced by spring 50. Thus, the level of intensity and hence, the level of sensory feedback, is completely up to the operator's desire and/or skill.

The variability in the degree of dependency between the steps permits a further variability in the more of exercise. A series of sprints and pauses may be accomplished by the operator by taking a number of rapid short steps, ending with both support steps 17 and 19 side by side at a position approximately three-quarters ($\frac{3}{4}$) of the stroke length upward from the bottom. If the operator then pauses, both support steps will sink downward to a position approximately one-quarter of the stroke length from the bottom. Exercise in this mode consists of a short burst of steps followed by a short pause, followed by a short burst of steps. Other variations are also possible. For example, a handicapped person may wish to exercise only one leg.

Figure 3:
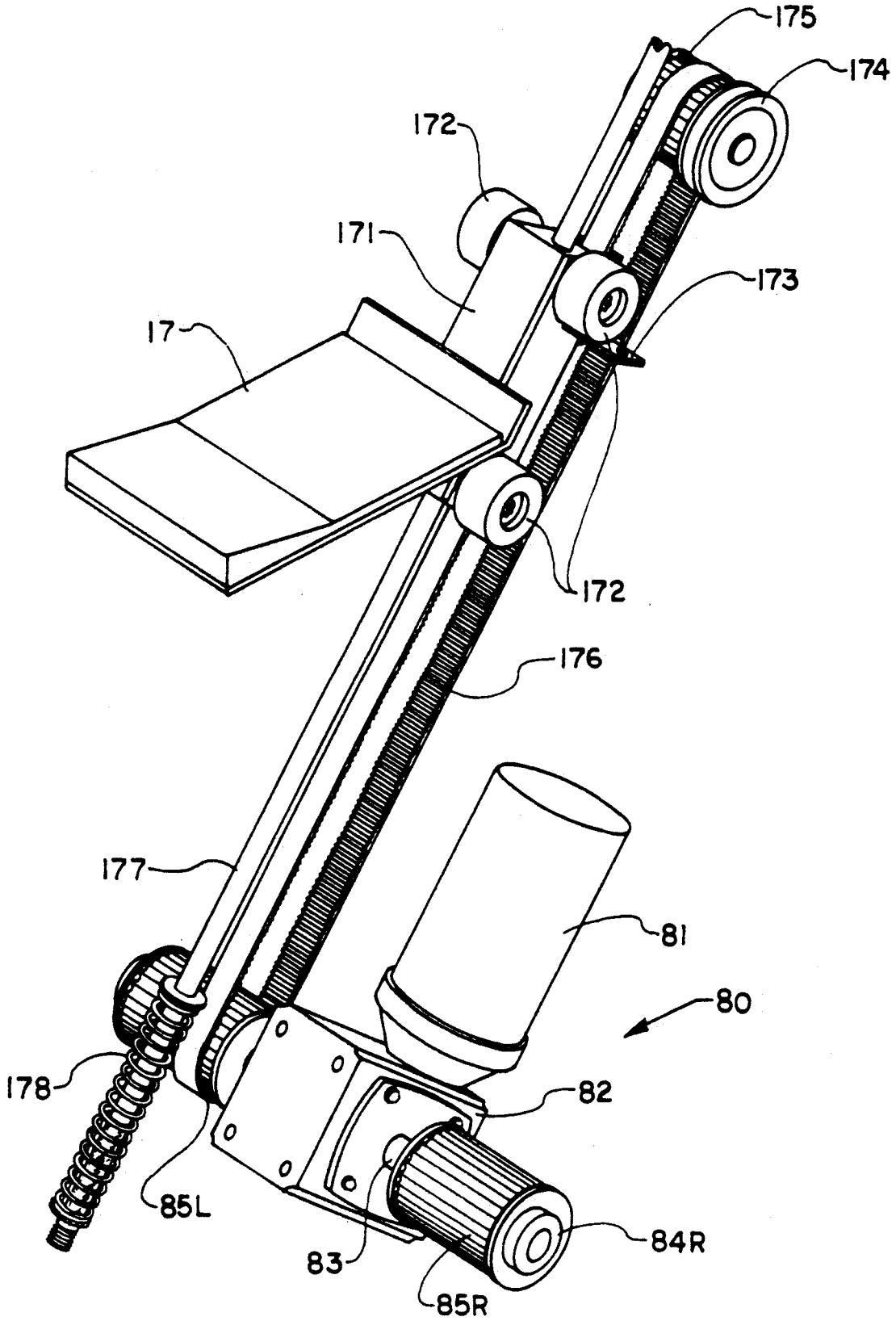
FIG. 3 is an isolated perspective view of the retarder means functionally connected to the left foot mechanism.

The stair climbing exerciser 10 also includes a retarder assembly designated generally by reference numeral 80 in FIG. 3. Once again, for purposes of clarity, FIG. 3 is an isolated view showing how retarder assembly 80 is functionally connected to each foot mechanism. For ease of description, retarder assembly 80 is shown in its functional relationship to left foot mechanism 171 only. Accordingly, the operative description will only focus on left foot mechanism 171. However, it is to be understood that right foot mechanism 191 is connected and operates in similar fashion.

Support step 17 is functionally connected to retarder assembly 80 by a toothed drive belt 176 connected to foot mechanism 171. Toothed drive belt 176 is in toothed engagement with lower and upper belt drive sprockets 85L and 175, respectively. Support step 17 along with foot mechanism 171 is guided in its stroke by a guide post 177 fixed within base 11. Once again, wheels 172 travel within a track (not shown) in order to stabilize the movement of support step 17. A booster spring 178 may also be provided at the bottom of the stroke for purposes of increasing the lifting force to the operator. This may be especially beneficial to the operator using the exerciser for rehabilitative purposes.

Retarder assembly 80 controls the speed of exerciser 10 using a combination of electric motor 81, worm drive gear assembly 82 and a unidirectional clutch. The universal clutch may include two clutches 84L and 84R. Clutch 84R is shown in FIG. 3 for right side of the exerciser. It is to be understood that a clutch 84L exists for the left side of the exerciser. Such apparatus was previously disclosed by applicant in U.S. Pat. No. 4,848,737 which is herein incorporated by reference. A brief description will follow with reference to FIGS. 3 and 4.

Referring to FIG. 3, the universal clutch is configured such that drive impulse can be transferred from the moving support step 17 to gear assembly 82 but cannot be transferred from motor 81 to support step 17. When the motor speed exceeds the step speed, the clutch disengages. A cutaway view, shown in FIG. 4, of the motor-gear-clutch assembly will shown the complimentary operation of worm drive gear assembly 82 and the unidirectional clutch.

Figure 4:
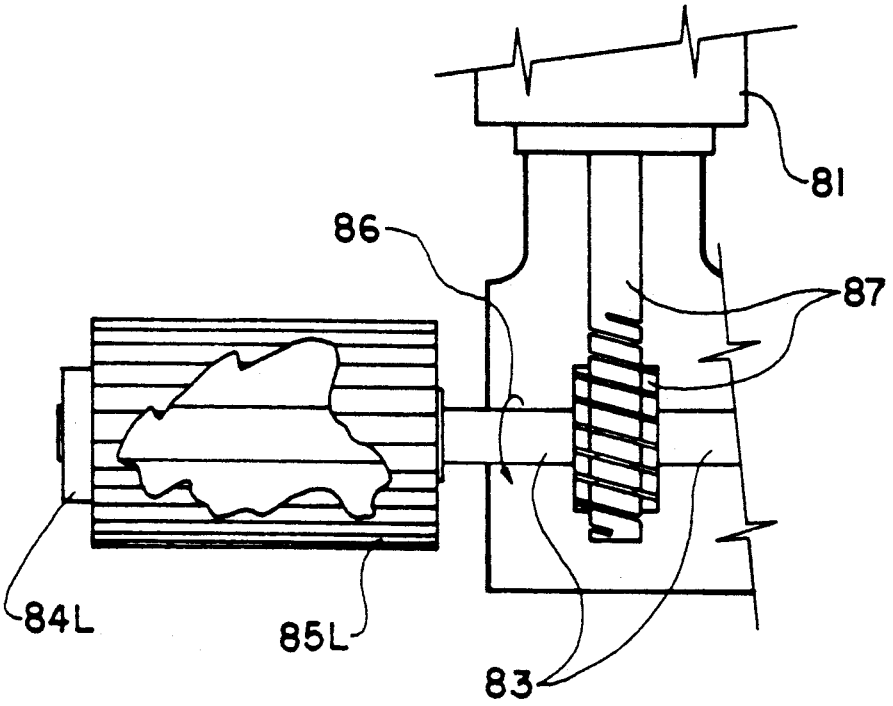
FIG. 4 is a partial cutaway view of the retarder assembly used in the present invention.

Referring now to FIG. 4, lower belt drive sprocket 85L is forced by operator weight to rotate as shown by arrow 86. Unidirectional clutch 84L locks thereby transmitting torque into a worm gear mechanism 87. However, no feed through to electric motor 81 can occur since worm gear mechanism 87 isolates the motor from the driving force. When rotation of belt drive sprocket 85L stops or drops below the speed of the worm drive output, clutch 84L disengages from drive shaft 83 so that the motion depicted by arrow 86 cannot be transmitted to support step 17. Accordingly, support step 17 is powered only by operator weight and never by the electric motor-worm drive assembly. Step speed may be monitored by a variety of sensor types that are connected to control panel 15 shown in FIG. 1 where a visual readout of speed is made available to the operator. Control panel 15 may include a motor speed control, thereby allowing the operator to adjust the speed capability of the exerciser.

Figure 5:
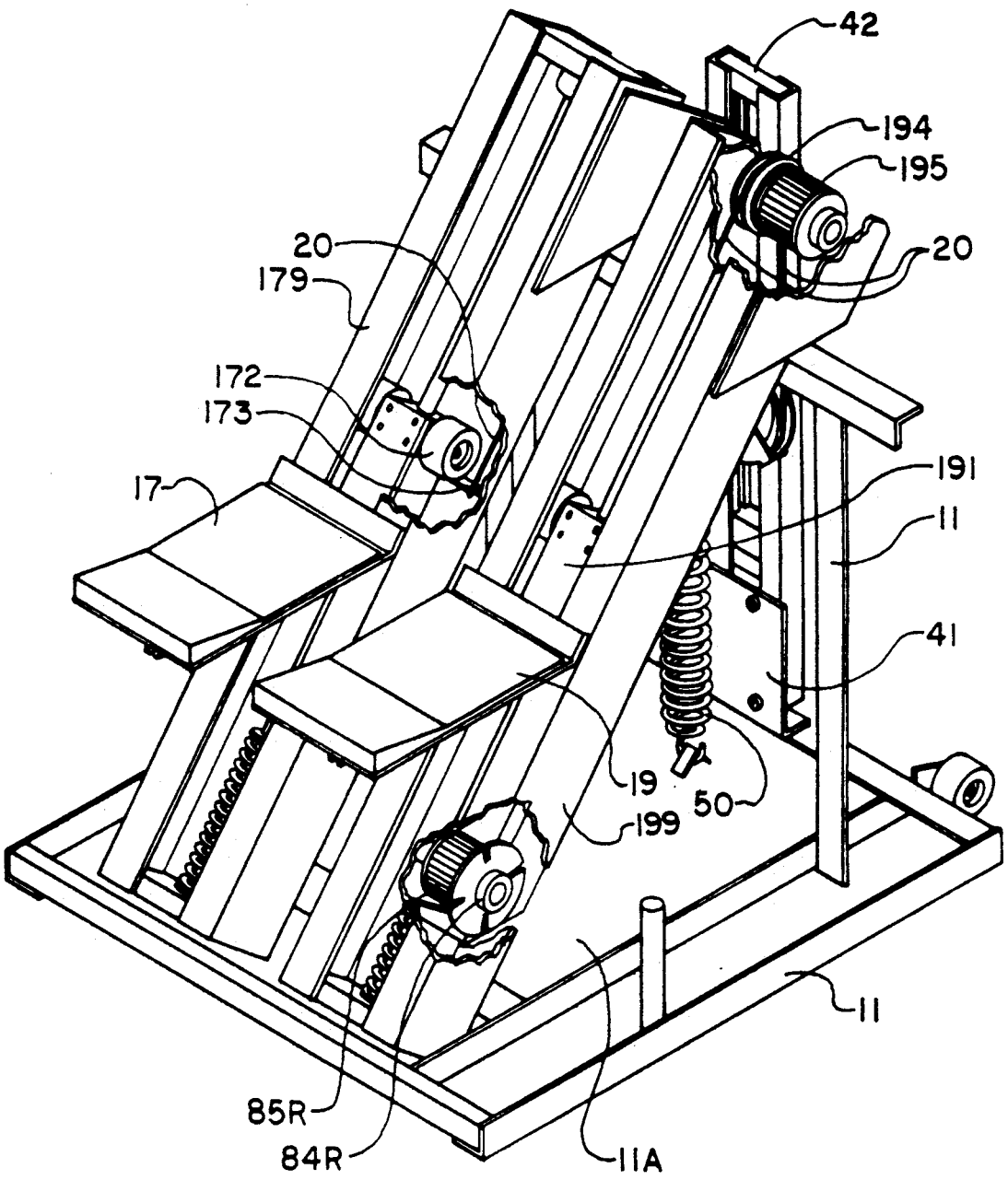
FIG. 5 is a perspective view with cutaways showing the structural relationship between the foot mechanisms, sensory feedback means and retarder means according to the present invention.

Finally, FIG. 5 is provided with cutaways to show the structural relationships between the foot mechanisms, sensory feedback assembly and retarder assembly. Common elements between FIGS. 1–4 share common reference numerals. Tracks 179 and 199 are provided for left and right foot mechanisms 171 and 191 where the mechanisms' respective wheels 172 and 192 travel. For purposes of clarity, no drive belt is shown around lower belt drive sprocket 85R and upper belt drive sprocket 195. Tracks 179 and 199 are parallel and linear to thereby provide a constant angle of climb which is the case in real stair climbing.

Figure 6:
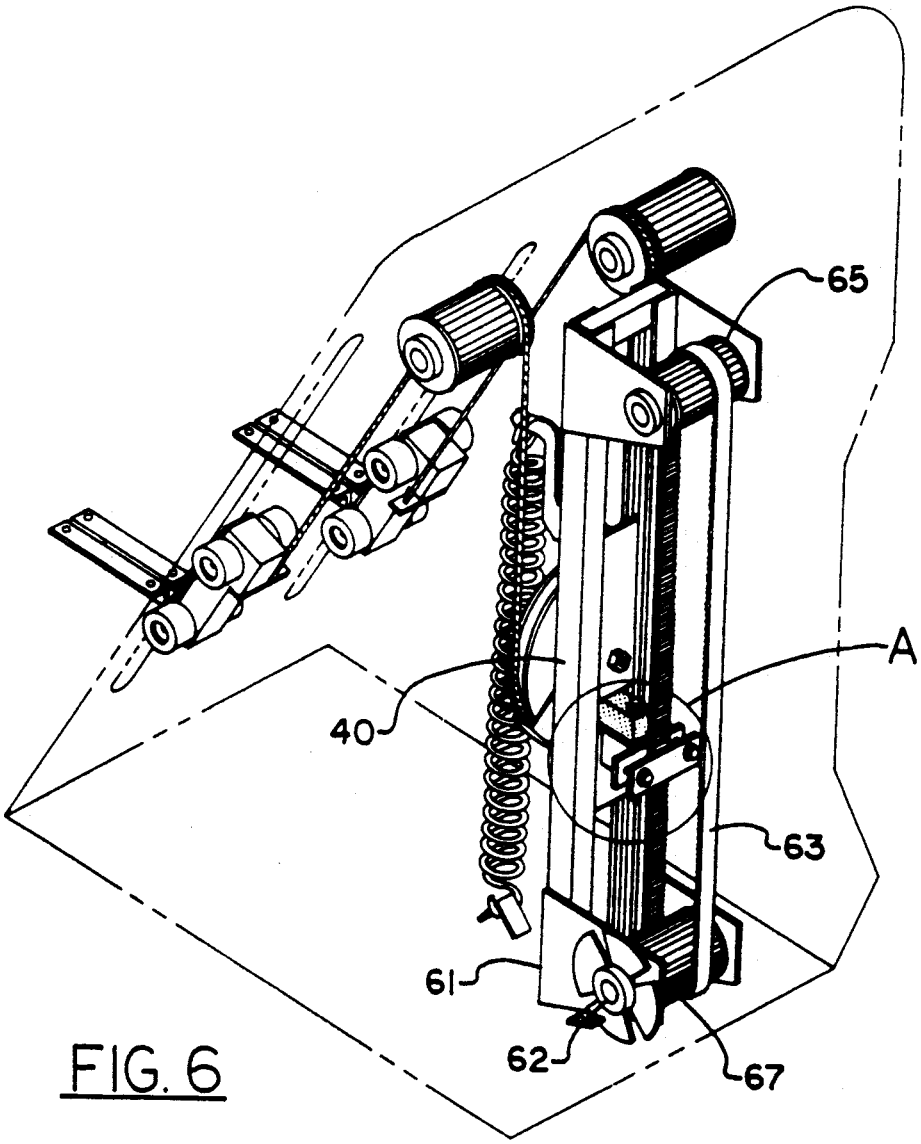
FIG. 6 is an isolated perspective view of the step interdependence adjustment mechanism.

The degree of independence of the steps provides special rehabilative effects in physical therapy uses. For example, exercise of a single leg which is sufficiently damaged or weakened that full support of body weight is not possible can be accomplished by using a maximum degree of independence of the steps. Maximum independence can be achieved by reducing the tension in spring 50 and by using a low modulus of elasticity, that is the spring should extend over the desired operating range without significant change in force. FIG. 6 depicts an alternate embodiment wherein the lower step for the spring-controlled pulley is vertically adjusted by a belt 63 mounted on an upper pulley 65 and a lower geared drive mechanism 67. The gear drive mechanism 67 is attached by locking device 62 to support plate 61. To increase dependent action of the step and stiffen the action of the pulley spring 50, it is necessary to raise the lower pulley stop and thereby restrict the downward travel of pulley 30. This action is accomplished by driving belt 63 with geared drive mechanism 67 to cause lower pulley stop assembly "A" to slide upward in channel 40.

Figure 6A:
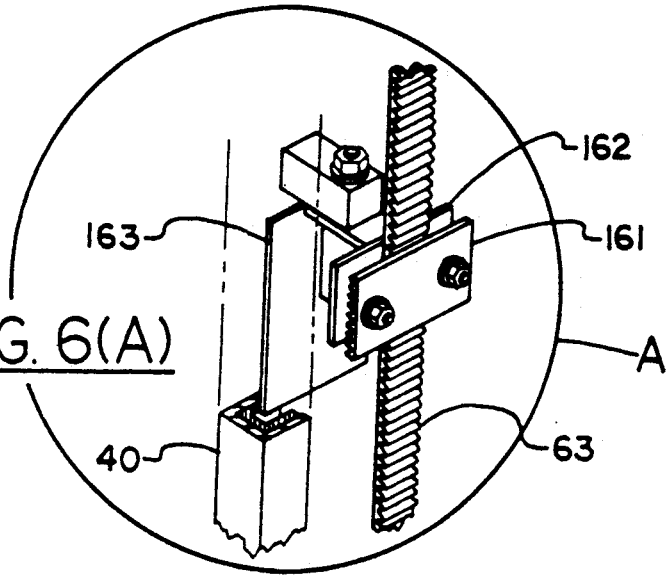
FIG. 6(A) is an exploded view of location "A" in FIG. 6.

Referring now to FIG. 6(A), a blown-up view of lower pulley-stop assembly "A" is shown. Slider plate 163 moves vertically inside channel 40 (an opposing channel on the opposite is not shown to promote clarity). Plates 162 and 161 clamp the lower pulley stop assembly to belt 63 which position the stop at the proper height to achieve the desired degree of dependence between the steps.

The advantages of the present invention are numerous. The present invention achieves a full range of stair climbing exercise levels that may be chosen and varied by the operator during the exercise routine. For the uninitiated, maximum sensory feedback is provided to the operator at the lower portion of the stepping stroke. For the expert, minimum sensory feedback is provided at the upper portion of the stepping stroke. Finally, for the average user, sensory feedback is provided at a level between the maximum and minimum based upon the stepping stroke locale chosen by the operator. Since the sensory feedback is based upon location of the stepping stroke, the operator can vary the amount of sensory feedback during his exercise routine.

Another advantage afforded by the design of the present invention is that an operator will always experience the same angle of climb regardless of length or position of the stroke. Just as in natural stair climbing, each foot moves ahead of the hip and returns directly underneath the hip with minimal stress on the knee joints. This is a great improvement over lever or pedal action simulators where each foot moves up and down under the hip causing the knee to bend at a more severe angle thereby causing increased joint stress.

Still another advantage of the present invention is the use of the retarder assembly as a brake on the speed of the stair climbing exerciser. An operator will never be able to drive the steps faster than the speed selected by the operator. Thus, the exerciser of the present invention has added element of safety over prior art stair climbing exercisers.

Thus, although the invention has been described relative to specific embodiments thereof, it is not so limited and numerous variations and modifications thereof will be readily apparent to those skilled in the art in light of the above teaching. It is therefore to be understood that within the scope of the appended claims the invention may be practiced otherwise than as specifically described.

What is claimed is:

1. An exercise apparatus for simulating a stair climbing exercise and for providing an operator with two stepping modes and a varying amount of sensory feedback to a lifting foot of the operator, comprising:

a base;

a frame extending from said base for providing the operator a means for balancing his upper body when performing the stair-climbing exercise;

left and right foot mechanisms housed within said base and having left and right foot support steps, each of said foot support steps extending from said base and being capable of substantially vertical upward and downward strokes, wherein the operator places his left foot and right foot on said left and right foot support steps, respectively, and wherein the left and right feed of the operator are alternatively the lifting foot in the stair climbing exercise; and an interconnection mechanism connecting said left and right foot mechanisms comprising an interconnection means and an indirect interconnection means whereby the foot mechanisms are caused to operate in a dependent stepping mode in the lower range of the stroke and in an independent stepping mode in the upper range of the stroke.

2. An exercise apparatus as in claim 1 wherein said interconnection means comprises;

a cable connected to each of said left and right foot mechanisms; and means for routing said cable between said left and right foot mechanisms and for allowing said left and right foot mechanisms to operate at or between said lower or upper portion of said left and right foot strokes.

3. An exercise apparatus as in claim 2, wherein said pulley means includes at least one positionable pulley connected to said base with a slidable mount whereby the location of the pulley within its slidable range is determined by the position of the foot mechanisms.

4. An exercise apparatus as in claim 3 wherein said pulley means further comprises a spring fixed on one end to said base and on the other end to said pulley, said spring being under minimum tension when said left and right foot mechanisms are operating at said upper range of their respective strokes and said spring being under maximum tension when said left and right foot mechanisms are operating at said lower range of their respective strokes.

5. An exercise apparatus as in claim 1 further comprising a moving retarder means functionally connected to said left and right foot mechanisms, said retarder means including an electric motor, worm gear drive mechanism, and unidirectional clutch, said retarder means functioning so that said clutch engages and functionally connects said retarder means to said left and right foot mechanism thereby limiting the speed of the stair-climbing exercise to a selected value.

6. An exercise apparatus as in claim 4 having a means for setting the initial tension of said spring.

7. An exercise apparatus as in claim 6 wherein said means for setting the spring initial tension is a moveable pulley stop assembly which holds said spring in a minimum extended position.

* * * * *

UNITED STATES PATENT AND TRADEMARK OFFICE

CERTIFICATE OF CORRECTION

PATENT NO. : 5,180,351
DATED : JANUARY 19, 1993
INVENTOR(S) : Ted Ehrenfried

It is certified that error appears in the above-indentified patent and that said Letters Patent is hereby corrected as shown below:

Claim 1 should read as follows:

Claim 1. An exercise apparatus for simulating a stair climbing exercise and for providing an operator with two stepping modes and a varying amount of sensory feedback to a lifting foot of the operator, comprising:

a base;

a frame extending from said base for providing the operator a means for balancing his upper body when performing the stair-climbing exercise;

left and right foot mechanisms housed within said base and having left and right foot support steps, each of said foot support steps extending from said base and being capable of substantially vertical upward and downward strokes, wherein the operator places his left foot and right foot on said left and right foot support steps, respectively, and wherein the left and right feet of the operator are alternatively the lifting foot in the stair climbing exercise; and

UNITED STATES PATENT AND TRADEMARK OFFICE

CERTIFICATE OF CORRECTION

PATENT NO. : 5,180,351

DATED : JANUARY 19, 1993

INVENTOR(S) : Ted Ehrenfried

It is certified that error appears in the above-indentified patent and that said Letters Patent is hereby corrected as shown below:

an interconnection mechanism connecting said left and right foot mechanisms comprising an interconnection means which including a floating pulley means, whereby the foot mechanisms are caused to operate in a dependent stepping mode in the lower range of the stroke and in an independent stepping mode in the upper range of the stroke.

Signed and Sealed this

Fifteenth Day of February, 1994

*Attest:*

Bruce Lehman

BRUCE LEHMAN

*Attesting Officer*

*Commissioner of Patents and Trademarks*